US007699139B2

(12) United States Patent
Subramaniam et al.

(10) Patent No.: US 7,699,139 B2
(45) Date of Patent: Apr. 20, 2010

(54) DIAPHRAGM SURROUND

(75) Inventors: K. Venkat Subramaniam, Westborough, MA (US); Zhen Xu, Westford, MA (US); Robert Preston Parker, Westborough, MA (US); Jason D. Silver, Framingham, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 11/756,119

(22) Filed: May 31, 2007

(65) Prior Publication Data

US 2008/0296086 A1 Dec. 4, 2008

(51) Int. Cl.

| | |
|---|---|
| ***H04R 7/18*** | (2006.01) |
| ***H04R 7/20*** | (2006.01) |
| ***H04R 1/28*** | (2006.01) |
| *G10K 13/00* | (2006.01) |
| *H04R 7/16* | (2006.01) |
| *H04R 1/20* | (2006.01) |

(52) U.S. Cl. ..... 181/171; 181/172; 381/392

(58) Field of Classification Search ..... 181/167–172, 181/166, 156, 173, 174; 381/392, 423, 429
See application file for complete search history.

(56) References Cited

U.S. PATENT DOCUMENTS

| | | | | | |
|---|---|---|---|---|---|
| 1,514,511 | A | | 11/1924 | Fischer | |
| 1,621,670 | A | | 3/1927 | Jokel | |
| 1,732,351 | A | * | 10/1929 | Borkman | 181/173 |
| 1,759,725 | A | | 5/1930 | Young et al. | |
| 1,821,933 | A | | 9/1931 | Darnell et al. | |
| 1,832,608 | A | * | 11/1931 | Abrahams | 181/171 |
| 2,020,705 | A | * | 11/1935 | Stenger | 181/172 |
| 2,302,178 | A | * | 11/1942 | Brennan | 181/169 |
| 2,439,665 | A | | 4/1948 | Marquis | |
| 2,624,417 | A | * | 1/1953 | Brennan | 181/169 |
| 2,863,520 | A | | 12/1958 | Manley et al. | |
| 3,436,494 | A | | 4/1969 | Bozak | |
| 3,563,337 | A | | 2/1971 | Kawamura | |
| 3,961,378 | A | * | 6/1976 | White | 29/594 |
| 3,983,337 | A | * | 9/1976 | Babb | 381/407 |
| 3,997,023 | A | * | 12/1976 | White | 181/171 |
| 4,235,302 | A | * | 11/1980 | Tsukamoto | 381/398 |
| 4,257,325 | A | * | 3/1981 | Bertagni | 181/172 |

(Continued)

FOREIGN PATENT DOCUMENTS

| | | |
|---|---|---|
| EP | 1 278 397 | 1/2003 |

(Continued)

OTHER PUBLICATIONS

International Search Report and Written Opinion in Application No. PCT/US2008/063562, dated Sep. 4, 2008.

(Continued)

*Primary Examiner*—Edgardo San Martin

(57) ABSTRACT

A surround for supporting a diaphragm used to create acoustic waves includes a rib section extending away from the diaphragm and a membrane section that is supported by the rib section. The membrane section has a thickness in a direction substantially normal to opposing top and bottom surfaces of the membrane section which is substantially thinner than a thickness of the rib section in a direction substantially normal to opposing top and bottom surfaces of the rib section. A restoring force returning the diaphragm to a home position is contributed to more due to deformation of the rib section than to deformation of the membrane section.

45 Claims, 11 Drawing Sheets

U.S. PATENT DOCUMENTS

| | | | | |
|---|---|---|---|---|
| 4,321,434 | A * | 3/1982 | Irie | 181/173 |
| 4,433,214 | A * | 2/1984 | Jasinski | 381/398 |
| 5,148,492 | A * | 9/1992 | Uzawa et al. | 381/177 |
| 5,150,417 | A * | 9/1992 | Stahl | 381/349 |
| 5,204,501 | A * | 4/1993 | Tsao | 181/156 |
| 5,319,718 | A * | 6/1994 | Yocum | 381/398 |
| 5,371,805 | A | 12/1994 | Saiki et al. | |
| 5,418,337 | A * | 5/1995 | Schreiber | 181/171 |
| 5,455,396 | A | 10/1995 | Willard et al. | |
| 5,650,105 | A * | 7/1997 | Yocum | 264/45.5 |
| 5,749,433 | A * | 5/1998 | Jackson | 181/156 |
| 6,044,925 | A * | 4/2000 | Sahyoun | 181/157 |
| 6,169,811 | B1 * | 1/2001 | Croft, III | 381/186 |
| 6,176,345 | B1 * | 1/2001 | Perkins et al. | 181/173 |
| 6,224,801 | B1 | 5/2001 | Mango, III | |
| 6,305,491 | B2 | 10/2001 | Iwasa et al. | |
| 6,347,683 | B2 * | 2/2002 | Schriever | 181/167 |
| 6,390,232 | B1 * | 5/2002 | Kirschbaum | 181/169 |
| 6,396,936 | B1 * | 5/2002 | Nevill | 381/349 |
| 6,611,604 | B1 * | 8/2003 | Irby et al. | 381/398 |
| 6,697,496 | B2 * | 2/2004 | Frasl | 381/398 |
| 6,725,967 | B2 | 4/2004 | Hlibowicki | |
| 6,889,796 | B2 * | 5/2005 | Pocock et al. | 181/172 |
| 6,957,714 | B2 | 10/2005 | Takahashi et al. | |
| 7,054,459 | B2 * | 5/2006 | Kuze et al. | 381/398 |
| 7,306,073 | B2 * | 12/2007 | Frasl | 181/173 |
| 7,397,927 | B2 * | 7/2008 | Pircaro et al. | 381/398 |
| 2003/0015369 | A1 | 1/2003 | Sahyoun | |
| 2006/0162993 | A1 * | 7/2006 | Honda et al. | 181/172 |
| 2007/0201712 | A1 | 8/2007 | Saiki | |

FOREIGN PATENT DOCUMENTS

| | | |
|---|---|---|
| EP | 1 381 251 | 1/2004 |
| GB | 329 278 | 5/1930 |
| GB | 329278 A | 5/1930 |

OTHER PUBLICATIONS

International Search Preliminary Report on Patentability, dated Jul. 28, 2009 issued for PCT/US2008/063562 filed May 14, 2008.

* cited by examiner

DIAPHRAGM SURROUND

BACKGROUND

This disclosure relates to a surround for supporting a diaphragm that is used to create acoustic waves. The surround and diaphragm can be part of a passive radiator or acoustic driver.

Passive radiators and acoustic drivers have been traditionally designed with half roll surrounds having a circular or elliptical cross section. Such half roll surrounds are typically made of high durometer materials. This arrangement provides approximate linear force-deflection response until the surround reaches a high strain that results in a non-linear response. In many surround designs, issues of buckling and hoop stresses can result in an unstable dynamic response (like sub harmonic rocking) which is detrimental to the acoustic performance.

SUMMARY

According to a first aspect, a surround for supporting a diaphragm used to create acoustic waves includes a rib section extending away from the diaphragm and a membrane section that is supported by the rib section. The membrane section has a thickness in a direction substantially normal to opposing top and bottom surfaces of the membrane section which is substantially thinner man a thickness of the rib section in a direction substantially normal to opposing top and bottom surfaces of the rib section. A restoring force returning the diaphragm to a home position is contributed to more due to deformation of the rib section than to deformation of the membrane section.

Further features include that the rib section is part of a first plurality of rib sections which extend away from the diaphragm. A second plurality of rib sections are included which are offset from the first plurality of rib sections. The second plurality of rib sections are offset radially from the first plurality of rib sections. The second plurality of rib sections are offset circumferentially from the first plurality of rib sections. The rib section comprises an elastomer. The rib section comprises a material having a Shore A durometer of between about 5 to about 70.

Additional features include that the second plurality of rib sections are joined to the first plurality of rib sections by a circumferential rib section. The second plurality of rib sections are connected to an attachment member. The first plurality of rib sections are connected to the diaphragm. The membrane section is between about 0.1 mm to about 5 mm thick. The rib section has a thickness of about 0.2 mm to about 25 mm. The membrane section is flat or curved. The membrane section and rib section form part of a passive radiator.

A still further feature includes a surround for supporting a diaphragm used to create acoustic waves. The surround includes a membrane section and a support section supporting the membrane section. The support section is substantially symmetric about an imaginary plane. The membrane section has a thickness in a direction substantially normal to opposing top and bottom surfaces of the membrane section which is substantially thinner than a thickness of the rib section in a direction substantially normal to opposing top and bottom surfaces of the rib section.

Additional features include that the support section is secured to at least one of the diaphragm and an attachment member. The support section includes at least two ribs. The two ribs extend in a substantially radial direction. The diaphragm is substantially planar and parallel to the imaginary plane. The imaginary plane bisects the membrane section. The support section extends above and below the membrane section. An envelope that closely encompasses the surround includes a substantially flat surface that is normal to an intended direction of travel of the diaphragm.

Another feature includes an acoustic system with a first diaphragm that creates acoustic waves when it is vibrated. A surround that supports the diaphragm includes a rib section that extends away from the first diaphragm. The surround includes a membrane section that is supported by the rib. The membrane section has a thickness in a direction substantially normal to opposing top and bottom surfaces of the membrane section which is substantially thinner than a thickness of the rib section in a direction substantially normal to opposing top and bottom surfaces of the rib section. The rib section and membrane section are made of substantially the same material.

An additional feature includes a method of creating acoustic waves. A surround is provided that is joined to a diaphragm which is used to create acoustic waves. The surround includes a membrane section and a support section connected to the membrane section. The support section is dividable into two substantially symmetrical portions by an imaginary plane. The membrane section has a thickness in a direction substantially normal to opposing top and bottom surfaces of the membrane section which is substantially thinner than a thickness of the rib section in a direction substantially normal to opposing top and bottom surfaces of the rib section. The diaphragm is caused to vibrate and create acoustic waves.

DETAILED DESCRIPTION

Active and passive acoustic sources (e.g. drivers and passive radiators) typically include a diaphragm that reciprocates back and forth to produce acoustic waves. This diaphragm (which may be e.g. a plate, cone, cup or dome) is usually attached to a non-moving structure using a resilient surround member.

Figure 1:
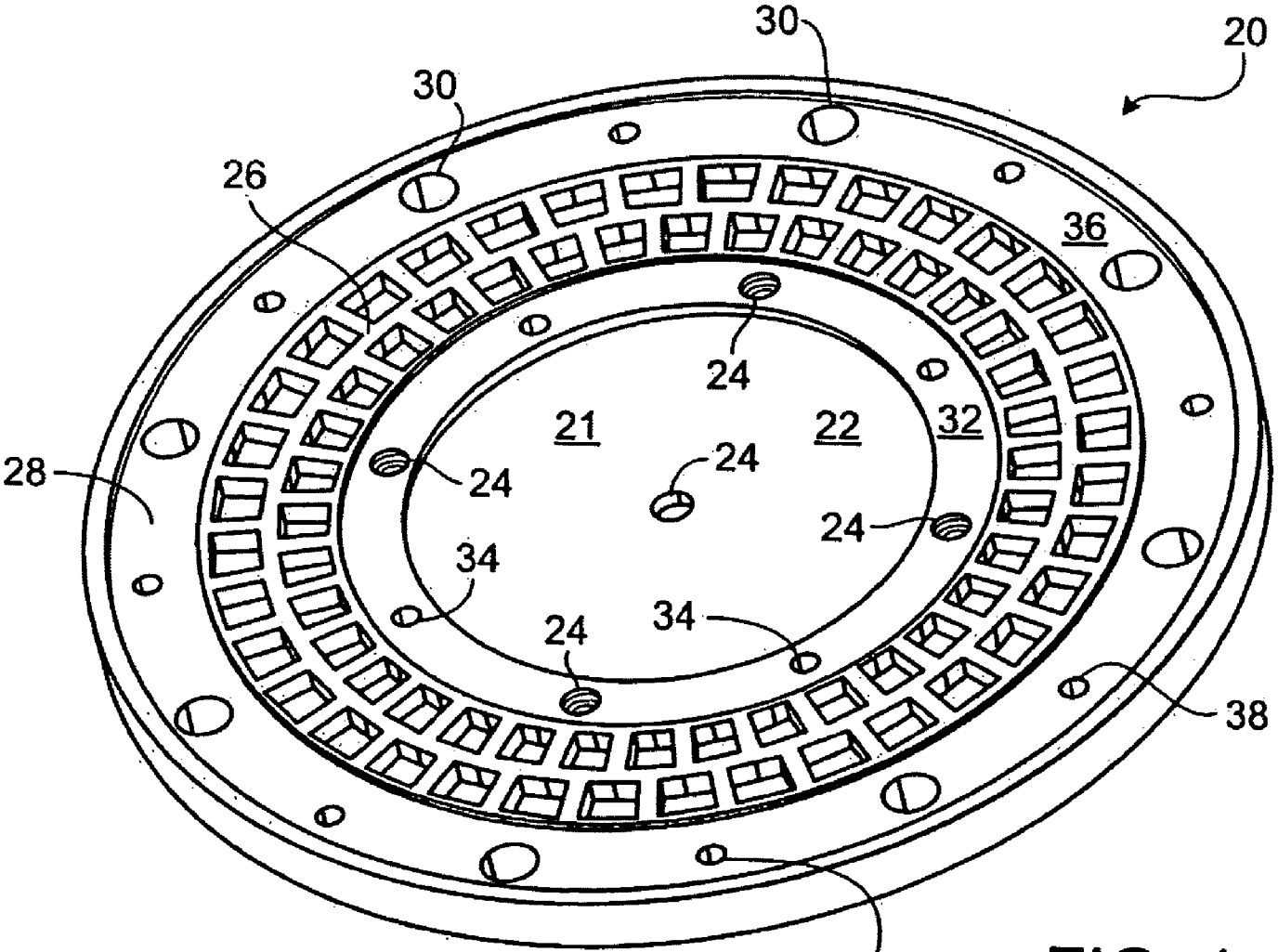
FIG. 1 is a schematic perspective view of a passive radiator.

For example, as shown FIG. 1, a passive radiator 20 includes a surround 26 that, connects a diaphragm 22 to an outer attachment ring 36. The diaphragm 22 has a top surface 21 which is substantially flat and made of a stiff material such, as plastic (e.g., polycarbonate or Acrylonitrile Butadiene Styrene) or metal (e.g., steel or aluminum). Alternatively, the top surface 21 of the diaphragm 22 may be convex or concave shaped to increase the stillness of the diaphragm.

The diaphragm 22 is exposed to acoustic waves created by another source such as an acoustic driver. The acoustic waves cause the diaphragm to vibrate back and forth in an intended direction of travel that is substantially perpendicular to a plane in which the diaphragm lies. This vibration causes additional acoustic waves to be created and propagated. A group of holes 24 in diaphragm 22 is used to secure a mass (not shown) which may be added to the diaphragm to tune to a desired resonant frequency of vibration.

The surround 26 is secured to and supports diaphragm 22. In this example the diaphragm 22 has a diameter of about 132 mm. The surround may be made of a solid or foam elastomer, and in this example is a thermoset soft silicone elastomer such as Mold Max 27T sold by Smooth-On. Inc., 2000 Saint John Street, Easton, Pa. 18042. Mold Max 27T is a tin-cured silicone rubber compound. Further details on Mold Max 27T can be found at www.smooth-on.com. The thermoset elastomer used to make surround 26 preferably has (i) a Shore A durometer of between about 5 to about 70, and more preferably has a durometer of about 27; (ii) a 100% elongation static modulus of between about 0.05 MPa to about 10 MPa, and more preferably has a 100% static modulus of about 0.6 MPa; (iii) an elongation at break above about 100%, and more preferably an elongation at break of about 400%; and (iv) a static stiffness of between about 0.05 newtons/mm to about 50 newtons/mm when the diaphragm is at its neutral travel position, and more preferably a static stiffness of about 3 newtons/mm. However, these properties may change depending on the diaphragm diameter, passive radiator system tuning frequency, and air volume in the speaker box.

Generally speaking, as the size of the surround gets smaller, a lower durometer material can be used. The use of a soft durometer material gives better design control for low free air resonant frequencies of the diaphragm to keep this resonant frequency away from the tuning frequencies of the moving mass of the diaphragm/surround assembly and a speaker box in which the surround is used.

An attachment ring (member) 28 is secured to and supports surround 26. Attachment ring 28 in this example is made of the same material used for diaphragm 22. Alternatively, the attachment ring 28 and the diaphragm 22 can be made of different materials. Ring 28 includes a series of large holes 30 that are used with fasteners (not shown) to secure the passive radiator to another structure (discussed further below). The arrangement of attachment ring 28, surround 26, and diaphragm 22 provides An appropriate linear force-deflection response of the diaphragm, which can advantageously result in low harmonic distortions and better dynamic performance.

Passive radiator 20 is typically made by forming diaphragm 22 and attachment ring 28 in separate injection molding operations. The diaphragm 22 and attachment ring 28 are then placed in an insert mold and a thermoplastic or thermoset elastomer is injected into the mold. The elastomer is allowed to cure thus forming surround 26. The thermoset elastomer covers the surfaces of the diaphragm 22 and the attachment ring 28 which face the surround 26. This assists in securing (joining) the surround 26 to the diaphragm 22 and the attachment ring 28. The elastomer also covers at least part of surfaces 32 and 36 (and their opposing surfaces), thereby helping to secure surround 26 to the diaphragm 22 and attachment ring 28. A series of holes 34 and 38 are injection holes through which molten elastomer is injected to form the surround 26.

Figure 3:
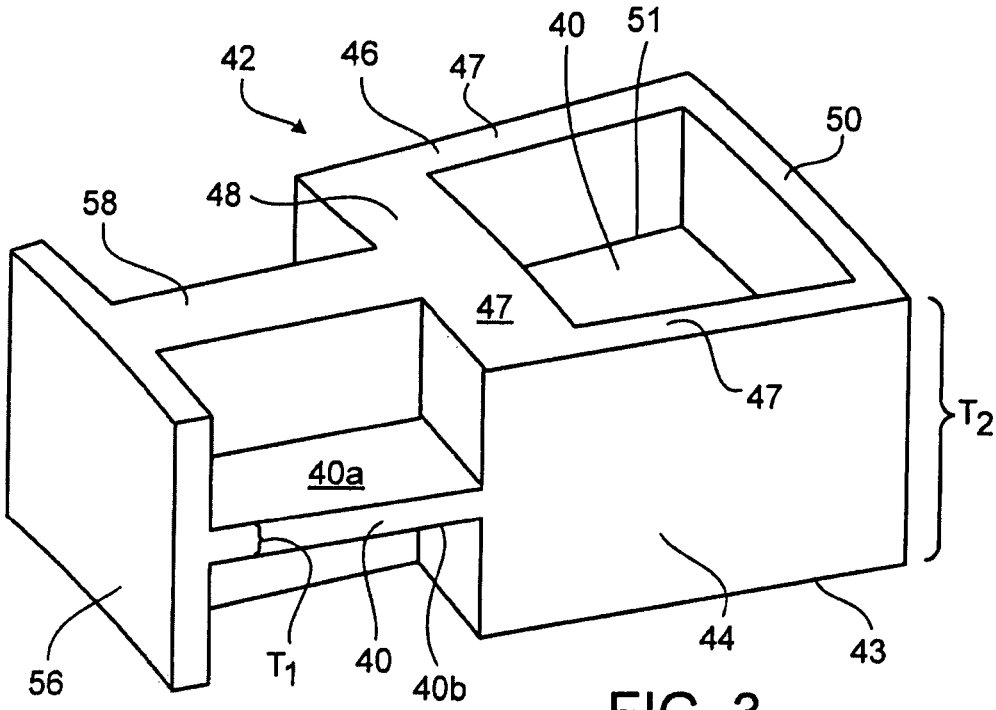
FIG. 3 is a sectional perspective view of a portion of the surround shown in FIG. 2.
Figure 2:
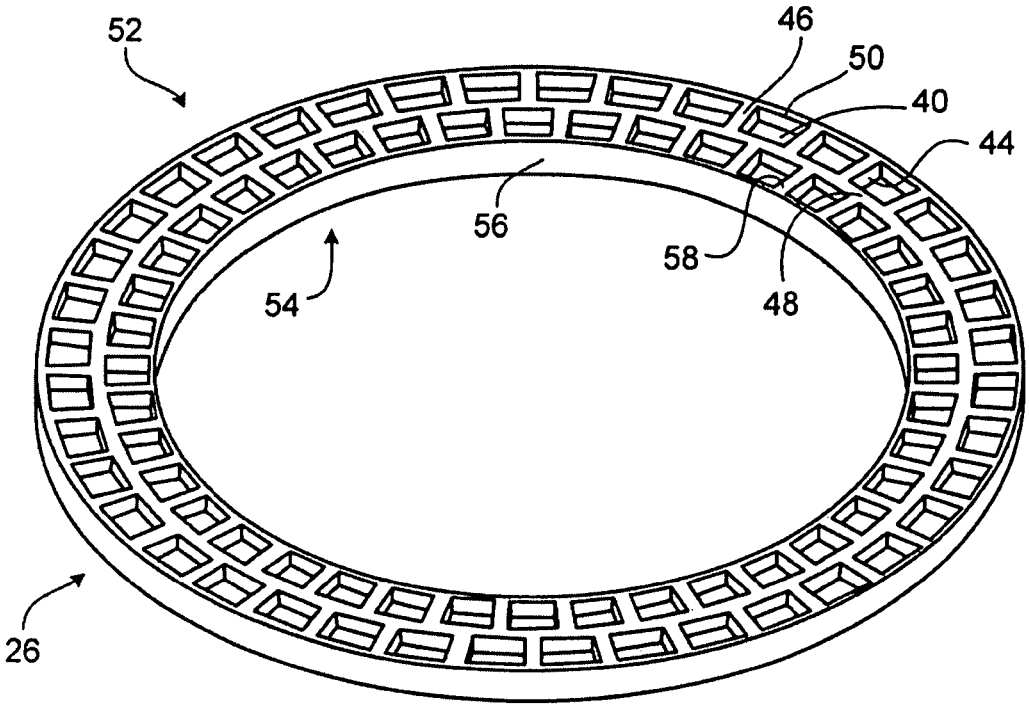
FIG. 2 is a schematic perspective view of a surround shown in FIG. 1.

Turning now to FIGS. 2 and 3, further details of the geometry of surround 26 will be described. The surround includes a plurality of generally flat (planar) membrane sections 40 which have a thickness $T_1$ of preferably between about 0.1 mm to about 5 mm (FIG. 3). Thickness $T_1$ is measured in a direction substantially normal to opposing top and bottom surfaces 40*a* and 40*b* of membrane section 40. In this example each membrane section is about 1 mm thick. Each membrane section 40 is supported by a support section 42. In this example the support section includes a pair of generally straight radial ribs 44, 46 (rib sections) as well as a generally circumferential rib 48 which ah support membrane section 40. All three of these ribs have a thickness $T_2$ of between about 0.2 mm to about 25 mm. The ribs 44, 46 and 48 each have a surface 47 (a top surface) that is substantially flat and substantially perpendicular to an intended direction of travel of the diaphragm 22. A bottom surface 43 of ribs 44, 46 and 48 is also substantially flat. Thickness $T_2$ is measured in a direction substantially normal to opposing top and bottom surfaces 47 and 43 of ribs 44, 46 and 48. An envelope that closely encompasses the surround 26 will include a substantially flat surface that is normal to an intended direction of travel of the diaphragm and coplanar with surface 47. In this example the thickness $T_2$ is about 8.5 mm resulting in the membrane section being substantially thinner than the ribs. The ribs of the support section symmetrically extend above and below the membrane section. The membrane and ribs are made of substantially the same material. As the diaphragm 2 starts moving away from a home position (shown in FIG. 1) the rib sections 44, 46 and 58 start to elastically elongate along their length (in a radial direction in this example). The rib sections 44, 46 and 58 will continue to elastically elongate as the diaphragm 22 moves in an intended direction (i.e. perpendicular to a plane in which the passive radiator lies) further away from the home position. The radial ribs return to their original length when the diaphragm 22 returns to its home position. A restoring force which returns the diaphragm to the home position is contributed to more due to deformation of the radial rib sections 44 and 46 than to deformation of the membrane section 40. The combined volume of all the radial ribs and circumferential rib 48 is about 27.5 $cm^3$. The combined volume of all the membrane sections is about 5.4 $cm^3$. This yields a volume ratio for this example of ribs to membrane sections of about 5.1. Generally speaking, as the surround gets smaller this ratio gets smaller. This ratio should preferably be at least about 0.3.

The circumferential rib 48 extends in a circumferential direction. Elastomer 56 is secured to attachment ring 28. Elastomer 56 is secured to the diaphragm 22. Each radial rib extends away from the diaphragm along substantially the rib's entire length in a generally radial direction (a direction perpendicular to an intended direction of travel of the diaphragm 22). Although the ribs 44, 46 are shown extending away at about a 90° angle to the diaphragm 22. ribs 44, 46 can be arranged to extend at an angle less than 90° (e.g., at an angle of 60° which would result in a triangular shaped membrane section). Radial ribs 44, 46 are in an outer group of radial ribs. Membrane section 40 has a pair of edges 51 (only one edge is visible in FIG. 3) which extend in a substantially radial direction and which are supported along their entire length by ribs 44 and 46. It should be noted that the interface between membrane section 40 and another element (e.g. rib 46) can be filleted. Because membrane section 40 and support section 42 are unitary, no air can leak past the interface between the membrane section and support section.

There are a large number of membrane sections and support sections in surround 26 arranged in two annular rings 52, 54 (FIG. 2). A radial rib 58 belongs to an inner group of radial ribs. The inner group of radial ribs (including rib 58) is offset radially from the outer group of radial ribs (which includes ribs 44, 46). This means that the outer group of ribs is further from center 24 than the inner group of ribs. The inner group of radial ribs is also offset circumferentially from the outer group of radial ribs. This means that the outer group of ribs is shifted in a circumferential direction from the inner group of ribs. The inner group of radial ribs are joined to the outer group of radial ribs by circumferential rib 48. The inner group of radial ribs (including rib 58) are joined to each other and connected to the diaphragm 22 by elastomer 56. The outer group of radial ribs (including ribs 44, 46) are joined to each other and connected to the attachment ring 28 by elastomer 50.

Figure 5:
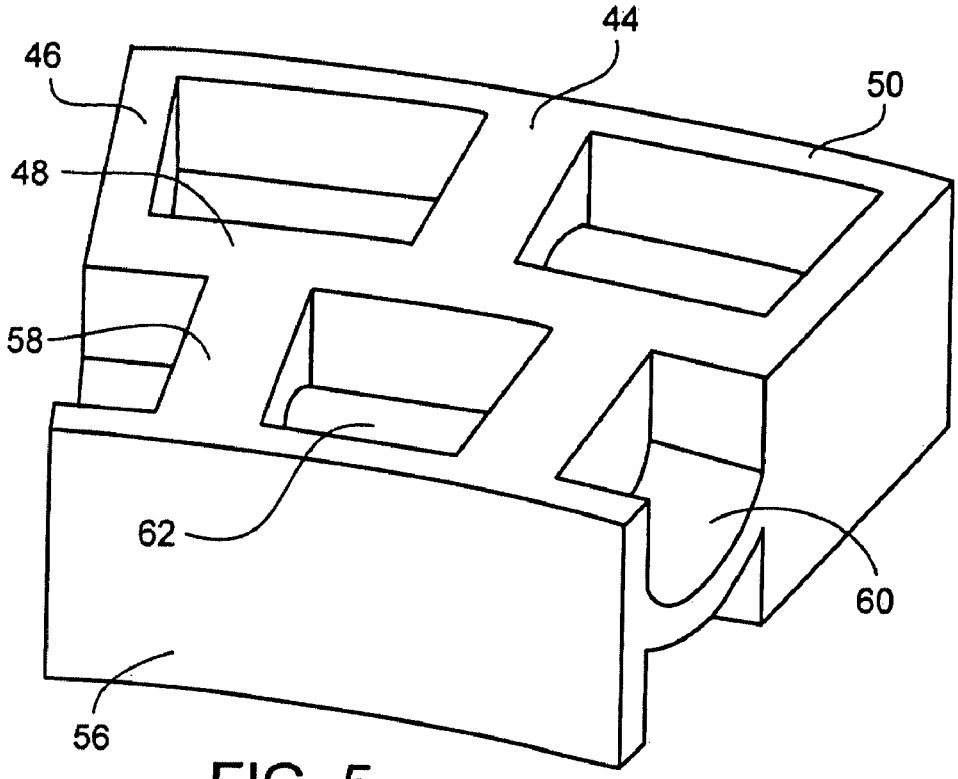
FIG. 5 is a sectional perspective view of a portion of the surround shown in FIG. 4.
Figure 4:
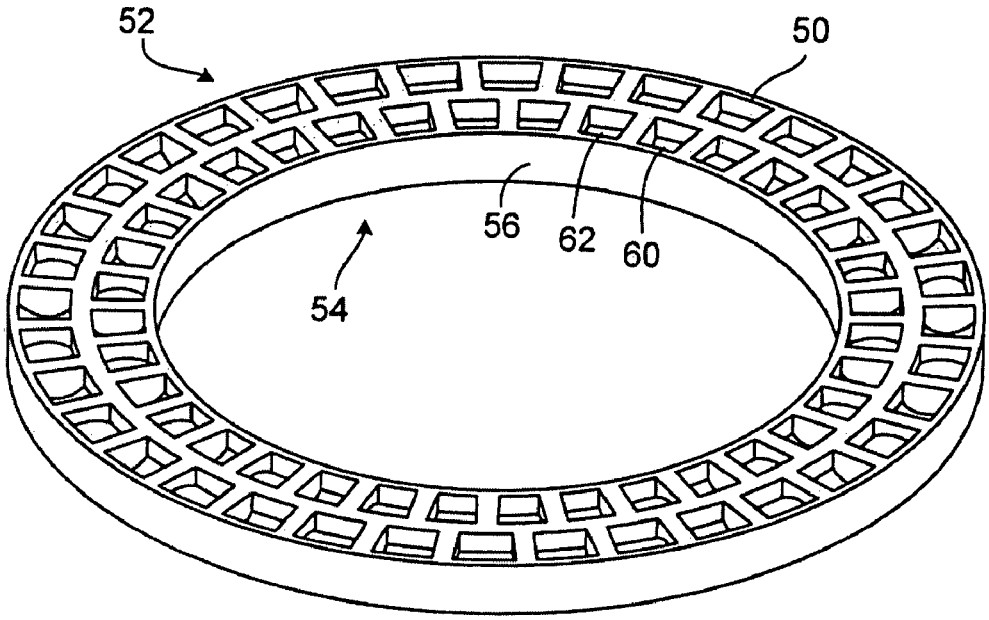
FIG. 4 is a schematic perspective view of a second example of a surround.

Referring now to FIGS. 4 and 5, another example of a surround is shown that is similar to the example shown in FIGS. 2 and 3 except that membrane sections 60, 62 are curved. The membrane sections alternate in a circumferential direction from being concave shaped (membrane 60) to convex shaped (membrane 62). It should be noted that the outer ring of membrane sections are also curved.

Figure 7:
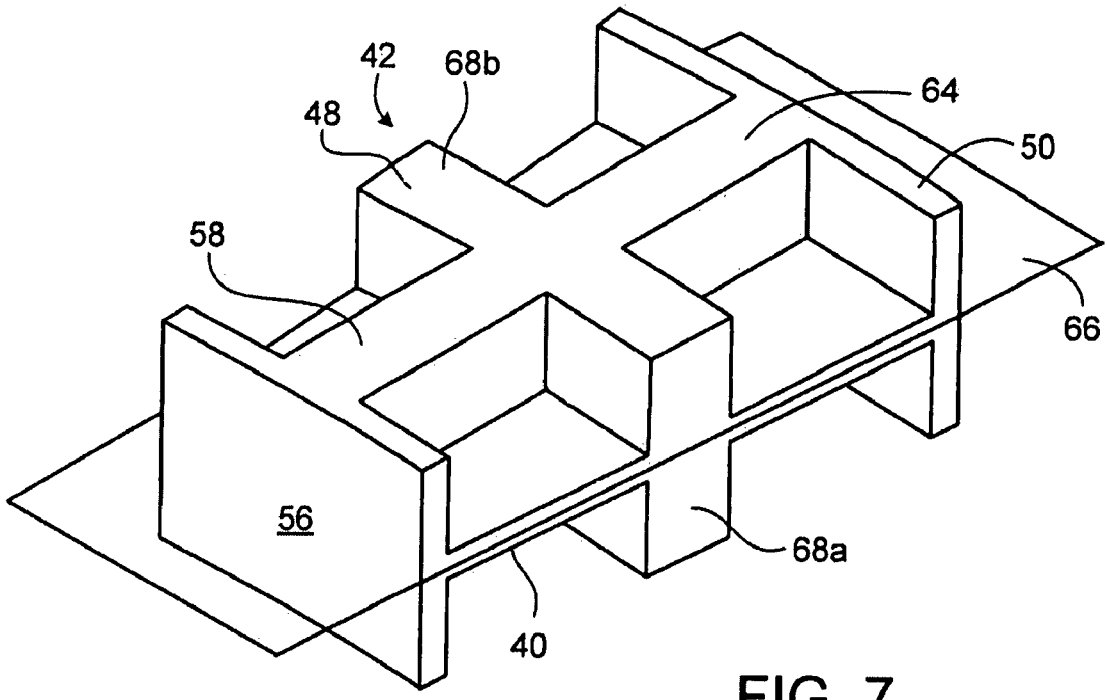
FIG. 7 is a sectional perspective view of a portion of the surround shown in FIG. 6.
Figure 6:
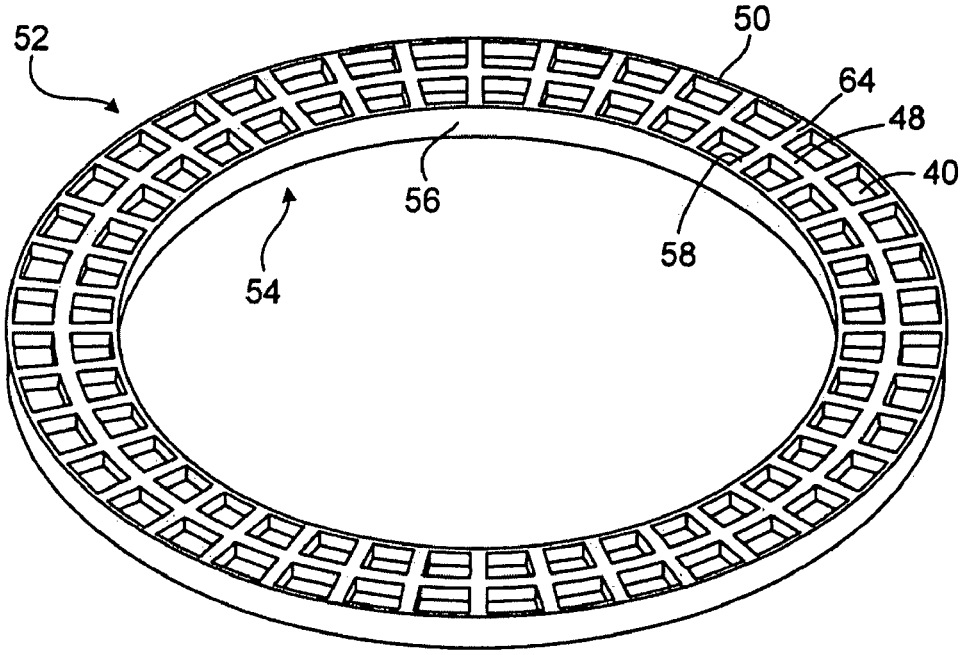
FIG. 6 is a schematic perspective view of a third example of a surround.

Turning to FIGS. 6 and 7, another example of a surround is shown that is similar to the example shown in FIGS. 2 and 3 except that each radial rib in the inner group (including rib 58) is aligned circumferentially with a respective radial rib in the outer group (including a rib 64).

Referring to FIG. 7, support section 42, including the radial and circumferential ribs, is symmetric about an imaginary plane 66 (this is true for the other illustrated examples in this disclosure). Portion 68*a* lies below plane 66 and portion 68*b* lies above the plane. Diaphragm 22 (FIG. 1) preferably lies in the plane 66. Additionally, for any of the examples with flat membrane sections (e.g. FIGS. 2, 3, 6 and 7) imaginary plane 66 bisects the membrane section. Assuming that the imaginary plane 66 aligns with the point of attachment of the surround to the diaphragm and the attachment ring, such symmetric design provides substantially similar responses for the both positive and negative travels of the diaphragm from its neutral rest position.

Figure 9:
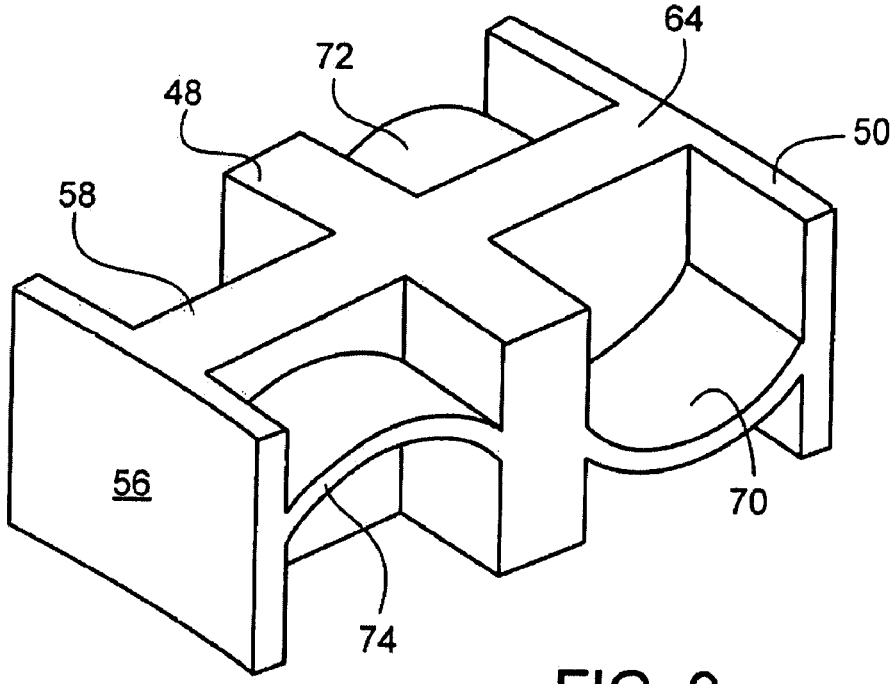
FIG. 9 is a sectional perspective view of a portion of the surround shown in FIG. 8.
Figure 8:
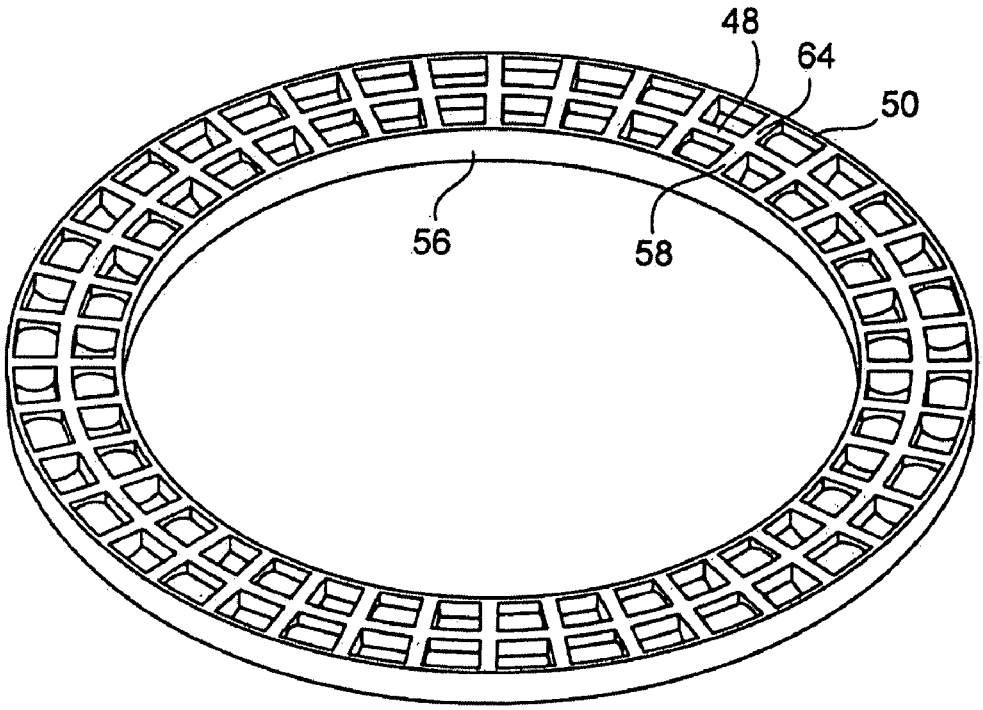
FIG. 8 is a schematic perspective view of a fourth example of a surround.

Referring to FIGS. 8 and 9, a further example of a surround is shown that is similar to the example shown in FIGS. 6 and 7 except that membrane sections 70, 72 are curved instead of being flat. The membrane sections alternate in a circumferential direction from being concave shaped (membrane 70) to convex shaped (membrane 72). The membrane sections also alternate in a radial direction from being concave shaped (membrane 70) to convex shaped (membrane 74).

Figure 11:
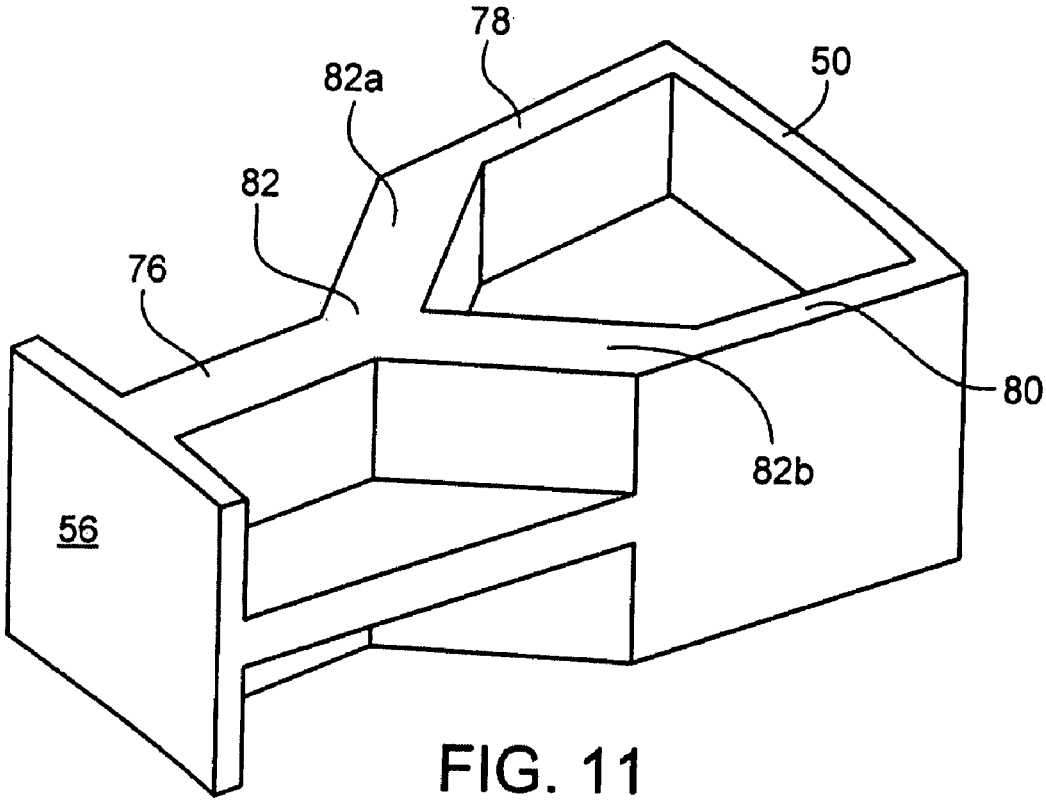
FIG. 11 is a sectional perspective view of a portion of the surround shown in FIG. 10.
Figure 10:
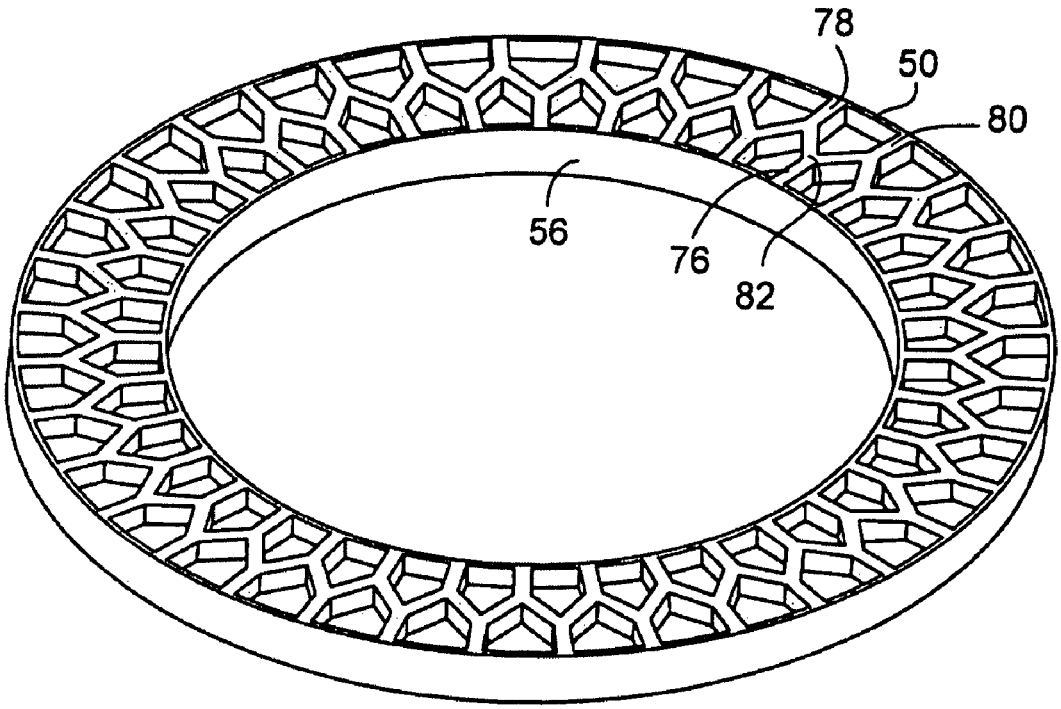
FIG. 10 is a schematic perspective view of a fifth example of a surround.

Referring now to FIGS. 10 and 11, another example of a surround is shown that is similar to the example shown in FIGS. 2 and 3 except that (a) radial ribs 44, 46 and 58 have been replaced by shortened (in the radial direction) radial ribs 78, 80, 76 and (b) circumferential rib 48 has been replaced by a zig-zagging rib 82 having a multiplicity of short rib sections 82*a*, 82*b*. These changes result in a pentagon-shaped membrane section.

Figure 13:
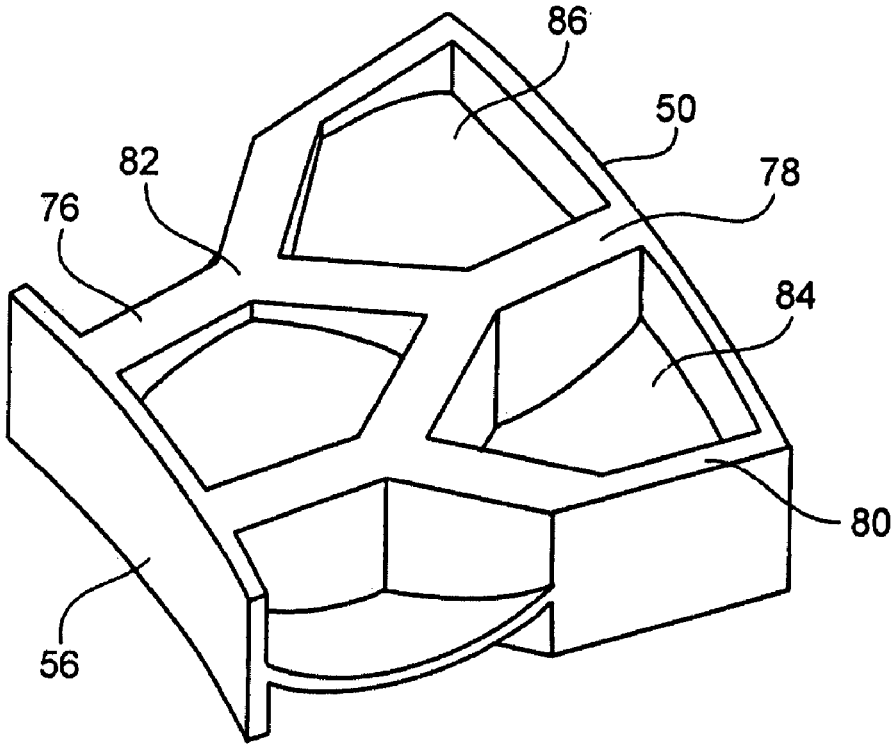
FIG. 13 is a sectional perspective view of a portion of the surround shown in FIG. 12.
Figure 12:
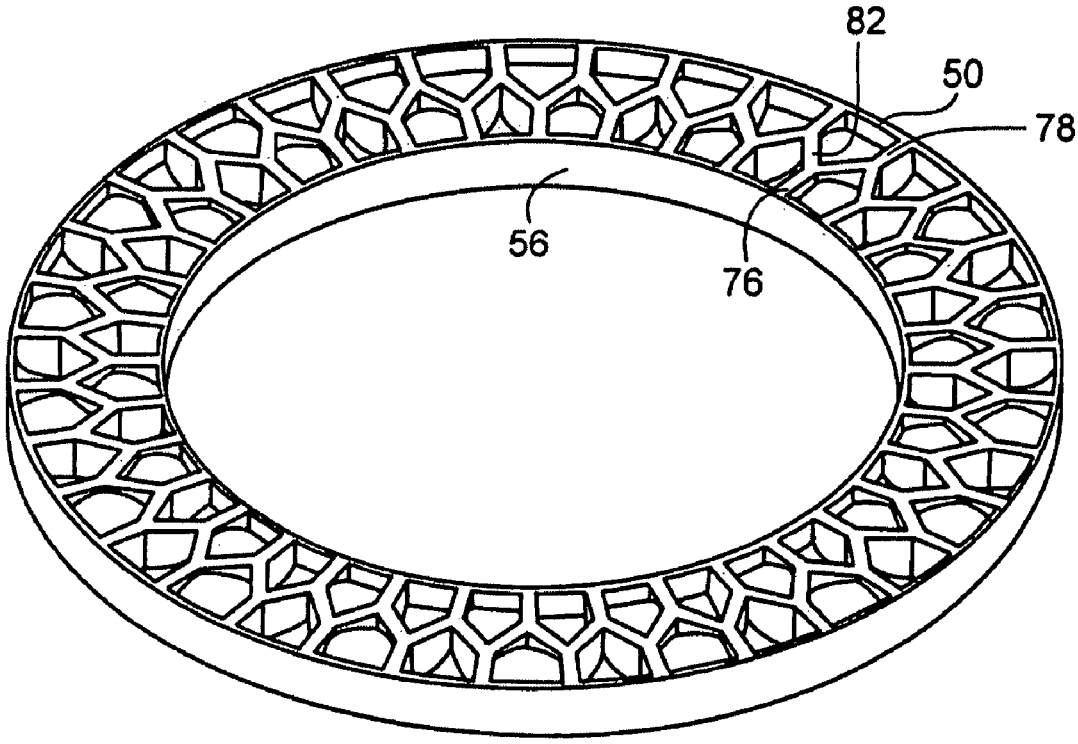
FIG. 12 is a schematic perspective view of a sixth example of a surround.

With reference to FIGS. 12 and 13, a further example of a surround is shown that is similar to the example shown in FIGS. 10 and 11 except that membrane sections 84, 86 are curved instead of being flat. The membrane sections alternate in a circumferential direction from being concave shaped (membrane 84) to convex shaped (membrane 86).

Figure 15:
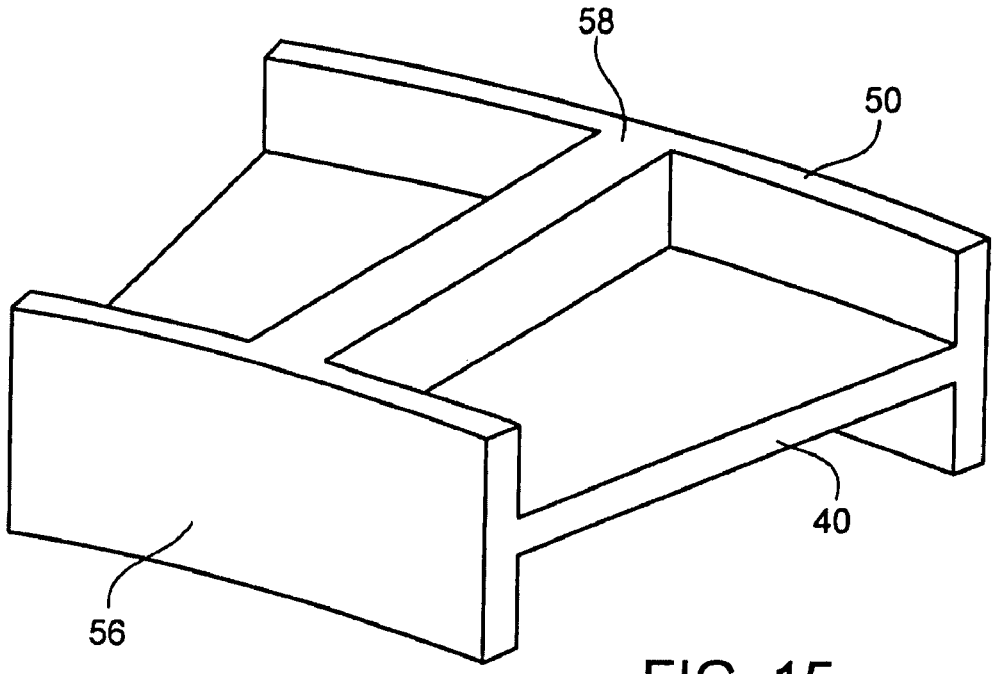
FIG. 15 is a sectional perspective view of a portion of the surround shown in FIG. 14.
Figure 14:
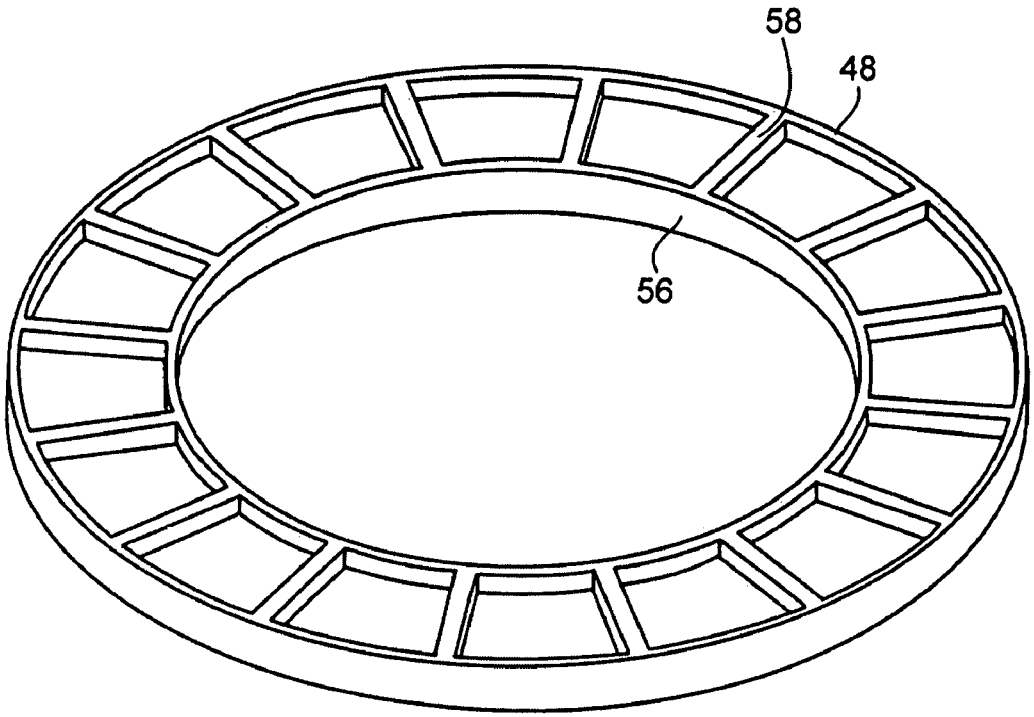
FIG. 14 is a schematic perspective view of a seventh example of a surround.

Referring now to FIGS. 14 and 15, another example is shown that is similar to the example shown in FIGS. 2 and 3 except that circumferential rib 48, the radial ribs in outer annular ring 52, and the membrane sections in outer annular ring 52 have been eliminated. This arrangement might be used for supporting a smaller diaphragm whereas the previous examples might be used to support a larger diaphragm.

Figure 17:
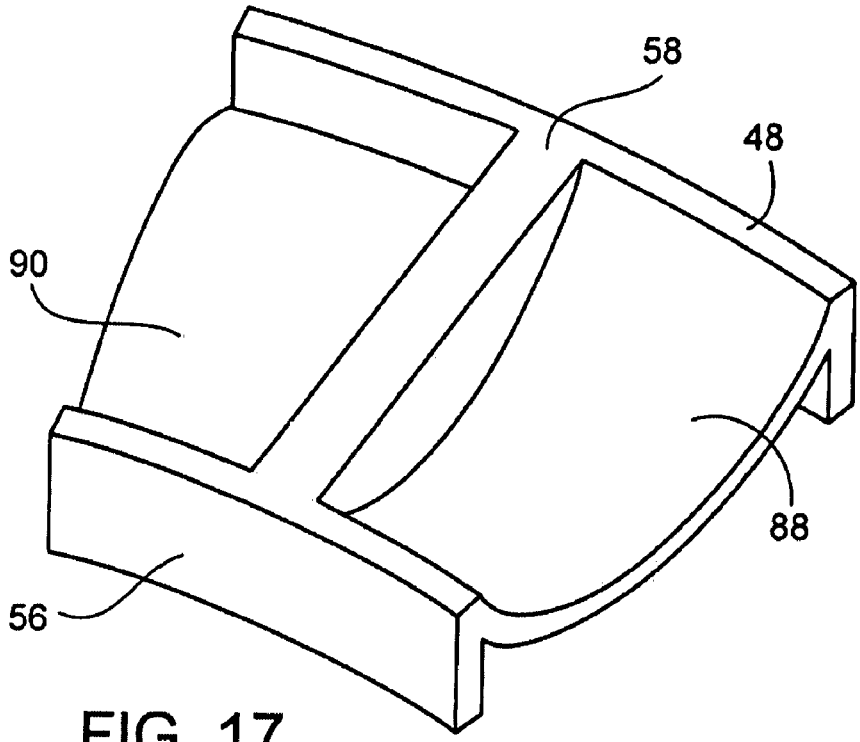
FIG. 17 is a sectional perspective view of a portion of the surround shown in FIG. 16.
Figure 16:
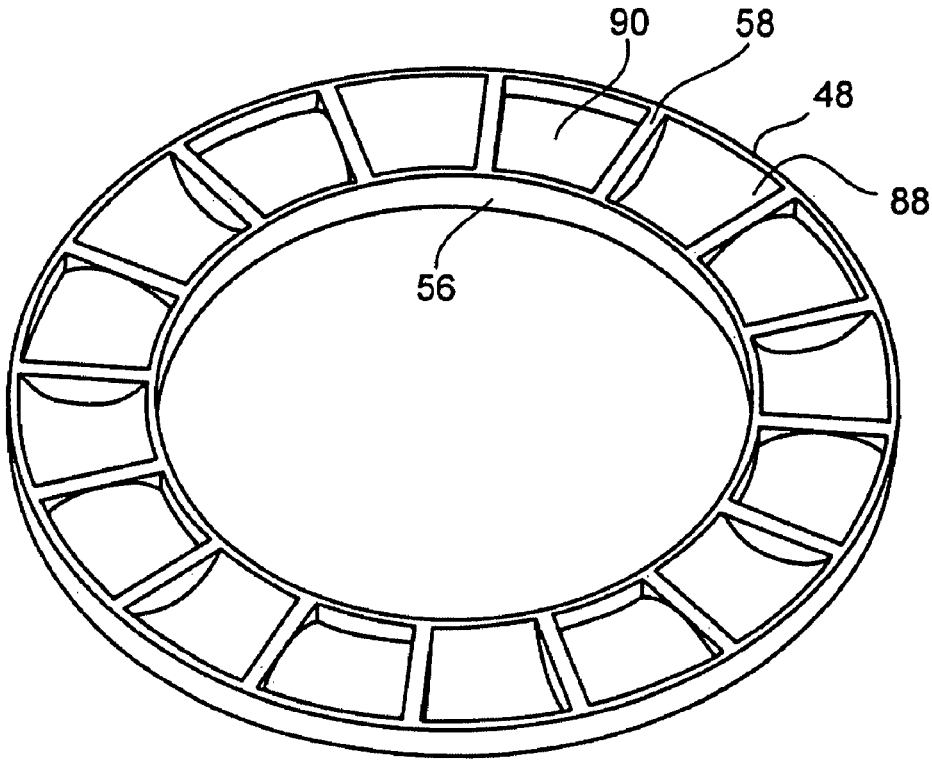
FIG. 16 is a schematic perspective view of an eighth example of a surround.

With reference to FIGS. 16 and 17, a further example of a surround is shown that is similar to the example shown in FIGS. 14 and 15 except that membrane sections 88, 90 are curved instead of flat. The membrane sections alternate in a circumferential direction from being concave shaped (membrane 88) to convex shaped (membrane 90).

Figure 19:
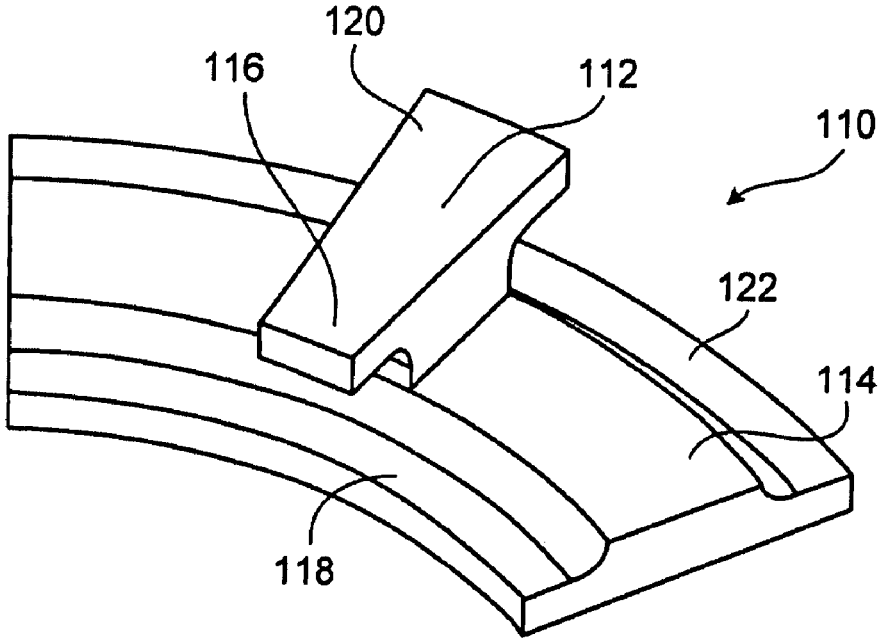
FIG. 19 is a sectional perspective view of a portion of the surround shown in FIG. 18.
Figure 18:
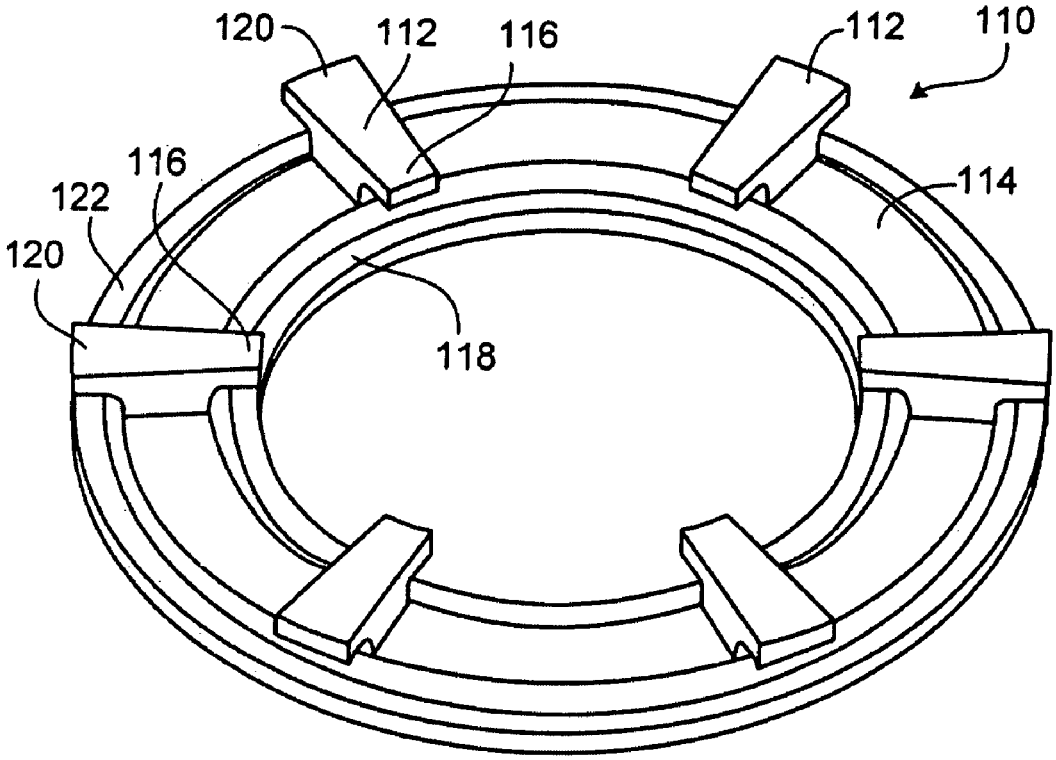
FIG. 18 is a schematic perspective view of an ninth example of a surround.

Turning to FIGS. 18 and 19, a surround 110 includes six radial ribs 112 and a membrane 114. The ribs 112 sit on top of the membrane 114. A diaphragm (not shown) is located between a first lip 116 of the ribs 112 and a first lip 118 of the membrane 114. An attachment ring is located between a second lip of the ribs 120 and a second lip 122 of the membrane 114. The surround 110 is insert molded to a preformed diaphragm and attachment ring.

Figure 20:
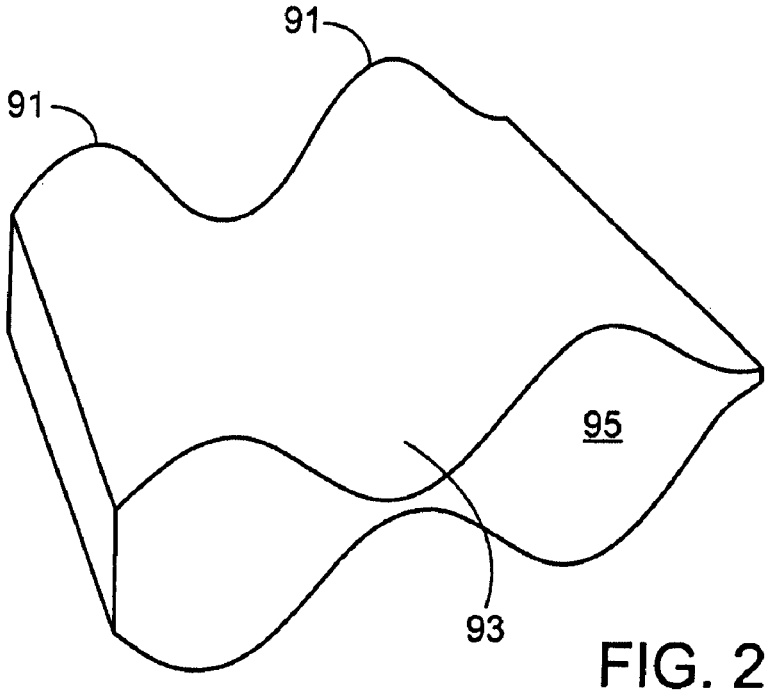
FIG. 20 is a sectional perspective view of a portion of a tenth example of a surround.

FIG. 20 provides another example of a surround. A pair of radial ribs 91 support a membrane section 93. In this example there is no clear line of demarcation between where the ribs end and where the membrane section begins. A portion 95 of the surround is secured to either a circumferential rib or to an attachment ring (not shown). A portion of the surround opposite the portion 95 is secured to a diaphragm (not shown).

Figure 21:
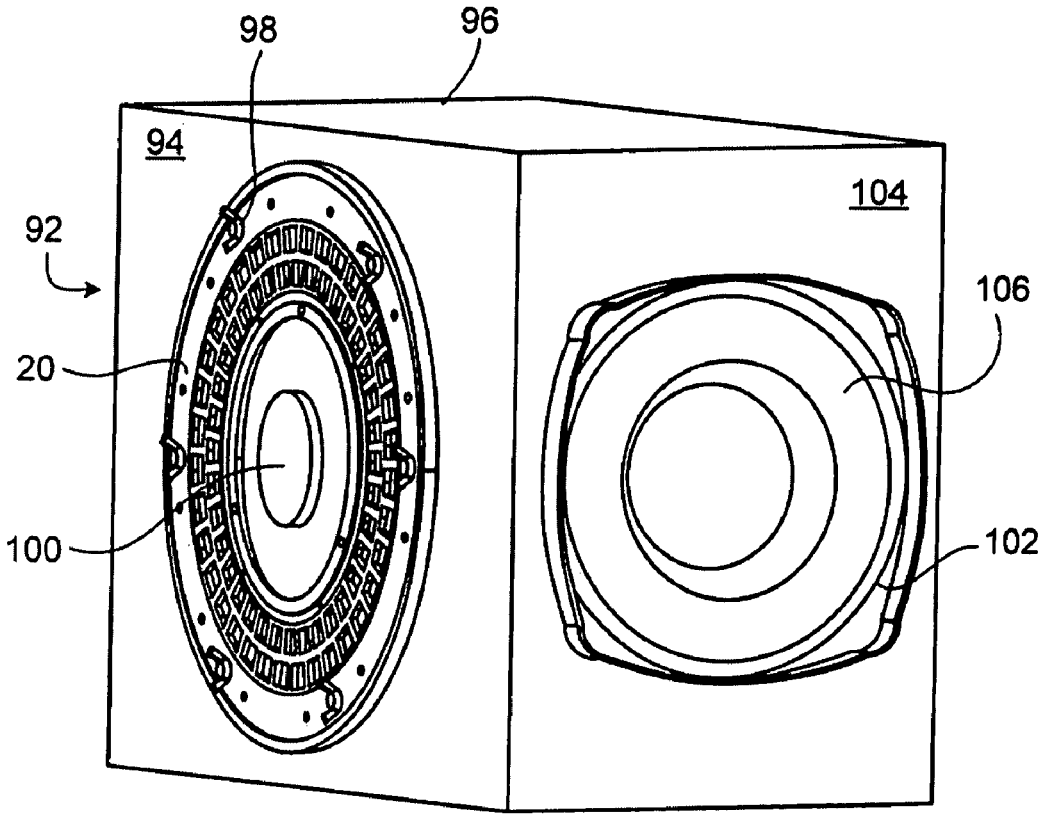
FIG. 21 is a schematic perspective view of a speaker incorporating the passive radiator of FIG. 1.

Turning now to FIG. 21, a speaker 92 includes passive radiator 20 of FIG. 1. The passive radiator is secured to a wall 94 of a speaker box 96 with a screws and wing nuts 98. A mass 100 has been secured to center hole 24. An acoustic driver 102 is secured to a wail 104 of the speaker box. The acoustic driver includes a diaphragm 106 that is caused to vibrate by a linear electro-magnetic motor. These vibrations create acoustic waves that propagate away from box 96 and other waves that propagate inside box 96. The acoustic waves inside box 96 cause diaphragm 22 of the passive radiator to vibrate, which in turn causes further acoustic waves to be created that propagate away from wall 94. It should be noted that the various surrounds described above can be used to support a diaphragm (e.g. diaphragm 106) used in an acoustic driver: the surrounds are not limited to being only used in a passive radiator application. The compact (i.e. flat) design of the surround of the passive radiator may allow for additional acoustic volume inside speaker box 96.

In general, the ribs of the support section provide a linear force-deflection response and the thin membrane provides a non-linear force deflection response. The total stiffness is a summation of the ribbed and the membrane responses so it is desirable to minimize the contribution of the membrane. One example provides a linear performance of the system over a 22 mm peak-to-peak travel of the diaphragm. In one example using a soft silicone rubber the rubber goes through an elongation or strain of about 30%.

While the invention has been particularly shown and described with reference to specific examples shown and described above, it is evident that those skilled in the art may now make numerous modifications of, departures from and uses of the specific apparatus and techniques herein disclosed. For instance, while the examples described herein are generally circular in shape, surrounds can be created in a number of other forms such as square, rectangular or racetrack shaped. Additionally, there are many different ways of arranging the ribs and membranes of the surround in addition to the several that have been described herein. Consequently, the invention is to be construed as embracing each and every novel feature and novel combination of features presented in or possessed by the apparatus and techniques herein disclosed and limited only by the spirit and scope of the appended claims.

What is claimed is:

1. A surround for supporting a diaphragm used to create acoustic waves, comprising:

a rib section extending away from the diaphragm; and a membrane section that is supported by the rib section, the membrane section having a thickness in a direction substantially normal to opposing top and bottom surfaces of the membrane section which is substantially thinner than a thickness of the rib section in a direction substantially normal to opposing top and bottom surfaces of the rib section, the top surface of the rib section being distinguishable from the top surface of the membrane section, the bottom surface of the rib section being distinguishable from the bottom surface of the membrane section, wherein a restoring force returning the diaphragm to a home position is contributed to more due to deformation of the rib section than to deformation of the membrane section, wherein the rib section comprises an elastomer, the membrane section and the diaphragm being made of materials which differ from each other.

2. The surround of claim 1, wherein the rib section is part of a first plurality of rib sections which extend away from the diaphragm.

3. The surround of claim 2, further including a second plurality of rib sections which are offset from the first plurality of rib sections.

4. The surround of claim 3, wherein the second plurality of rib sections are offset radially from the first plurality of rib sections.

5. The surround of claim 4, wherein the second plurality of rib sections are offset circumferentially from the first plurality of rib sections.

6. The surround of claim 3, wherein the second plurality of rib sections are offset circumferentially from the first plurality of rib sections.

7. The surround of claim 1, wherein the rib section comprises a material having a Shore A durometer of between about 5 to about 70.

8. The surround of claim 3, wherein the second plurality of rib sections are joined to the first plurality of rib sections by a circumferential rib section.

9. The surround of claim 3, wherein the second plurality of rib sections are connected to an attachment member.

10. The surround of claim 2, wherein the first plurality of rib sections are connected to the diaphragm.

11. The surround of claim 1, wherein the membrane section is between about 0.1 mm to about 5 mm thick.

12. The surround of claim 1, wherein the rib section has a thickness of about 0.2 mm to about 25 mm.

13. The surround of claim 1, wherein the membrane section is flat.

14. The surround of claim 1, wherein the membrane section is curved.

15. The surround of claim 1, wherein the membrane section and rib section form part of a passive radiator.

16. A surround for supporting a diaphragm used to create acoustic waves, comprising:

a membrane section; and a support section supporting the membrane section, wherein the support section is substantially symmetric about an imaginary plane, the membrane section having a thickness in a direction substantially normal to opposing top and bottom surfaces of the membrane section which is substantially thinner than a thickness of the support section in a direction substantially normal to opposing top and bottom surfaces of the support section, the top surface of the support section being distinguishable from the top surface of the membrane section, the bottom surface of the support section being distinguishable from the bottom surface of the membrane section, wherein the membrane section comprises an elastomer, the membrane section and the diaphragm being made of materials which differ from each other.

17. The surround of claim 16, wherein the membrane section is about 0.1 mm to about 5 mm thick.

18. The surround of claim 16, wherein the support section has a thickness of about 0.2 mm to about 25 mm thick.

19. The surround of claim 16, wherein the support section is secured to at least one of the diaphragm and an attachment member.

20. The surround of claim 16, wherein the support section includes at least two ribs.

21. The surround of claim 20, wherein the two ribs extend in a substantially radial direction.

22. The surround of claim 16, wherein the support section includes a rib that extends in a circumferential direction.

23. The surround of claim 16, wherein the diaphragm is substantially planar and parallel to the imaginary plane.

24. The surround of claim 16, wherein the imaginary plane bisects the membrane section.

25. The surround of claim 16, wherein the support section extends above and below the membrane section.

26. An acoustic system, comprising;

a first diaphragm that creates a first group of acoustic waves when it is vibrated; and a surround for supporting the first diaphragm, the surround including a rib section that extends away from the first diaphragm, the surround including first and second membrane sections that is are supported by the rib section, the membrane sections each having a thickness in a direction substantially normal to opposing top and bottom surfaces of each membrane section which is substantially thinner than a thickness of the rib section in a direction substantially normal to opposing top and bottom surfaces of the rib section, wherein the top surface of the first membrane section has a substantially concave shape and the top surface of the second membrane section has a substantially convex shape, the rib section and membrane sections being made of substantially the same material, wherein the rib section comprises an elastomer, the rib section and the diaphragm being made of materials which differ from each other.

27. The acoustic system of claim 26, wherein the rib section is part of a first plurality of rib sections which extend in a substantially radial direction.

28. The acoustic system of claim 27, further including a second plurality of rib sections which are offset from the first plurality of rib sections.

29. The acoustic system of claim 28, wherein the second plurality of rib sections are offset radially from the first plurality of rib sections.

30. The acoustic system of claim 28, wherein the second plurality of rib sections are offset circumferentially from the first plurality of rib sections.

31. The acoustic system of claim 26, wherein the rib section comprises a material having a Shore A durometer of between about 5 to about 50.

32. The acoustic system of claim 28, wherein the second plurality of rib sections are joined to the first plurality of rib sections by a circumferential rib section.

33. The acoustic system of claim 26, wherein the membrane section is between about 0.1 mm to about 5 mm thick..

34. The acoustic system of claim 26, wherein the rib section has a thickness of about 0.2 mm to about 25 mm thick.

35. The acoustic system of claim 26, further including an acoustic driver that includes a second diaphragm that is translated back and forth by an electro-magnetic motor to create a second group of acoustic waves, the second group of acoustic waves causing the first diaphragm to vibrate and create the first group of acoustic waves.

36. A method of creating acoustic waves, comprising the steps of:

providing a surround that is joined to a diaphragm which is used to create acoustic waves, the surround including a membrane section and a support section connected to the membrane section, wherein the support section is dividable into two substantially symmetrical portions by an imaginary plane, the membrane section having a thickness in a direction substantially normal to opposing top and bottom surfaces of the membrane section which is substantially thinner than a thickness of the support section in a direction substantially normal to opposing top and bottom surfaces of the support section, the top surface of the support section being distinguishable from the top surface of the membrane section, the bottom surface of the support section being distinguishable from the bottom surface of the membrane section; and causing the diaphragm to vibrate and create acoustic waves, wherein the membrane section comprises an elastomer, the membrane section and the diaphragm being made of materials which differ from each other.

37. The method of claim 36, wherein the membrane section is about 0.1 mm to about 5 mm thick.

38. The surround of claim 36, wherein the support section has a thickness of about 0.2 mm to about 25 mm.

39. The surround of claim 36, wherein the support section is secured to the diaphragm.

40. The surround of claim 36, wherein the support section includes at least two ribs.

41. The surround of claim 40, wherein the two ribs extend in a radial direction.

42. The surround of claim 36, wherein the support section includes a rib that extends in a circumferential direction.

43. The surround of claim 1, wherein a surface of the rib section is substantially flat, the surface being substantially perpendicular to an intended direction of travel of the diaphragm.

44. The surround of claim 1, wherein the rib and membrane sections are made of substantially the same material.

45. The surround of claim 1, wherein an envelope that closely encompasses the surround will include a substantially flat surface that is normal to an intended direction of travel of the diaphragm.

* * * * *